US007127772B2

(12) United States Patent
Dingert et al.

(10) Patent No.: US 7,127,772 B2
(45) Date of Patent: Oct. 31, 2006

(54) WIPER PLATE FOR A CLEANING IMPLEMENT

(75) Inventors: Uwe Dingert, Abtsteinach (DE); Nacho Alba, St. Cugar/Spanien (ES); Hans-Jürgen Wendelken, Sinsheim (DE)

(73) Assignee: Carl Freudenberg KG, Weinheim (DE)

( * ) Notice: Subject to any disclaimer, the term of this patent is extended or adjusted under 35 U.S.C. 154(b) by 0 days.

(21) Appl. No.: 10/287,938

(22) Filed: Nov. 4, 2002

(65) Prior Publication Data

US 2003/0084531 A1 May 8, 2003

(30) Foreign Application Priority Data

Nov. 5, 2001 (DE) ..... 101 53 801

(51) Int. Cl.
*A47L 13/12* (2006.01)
*A47L 13/20* (2006.01)

(52) U.S. Cl. ..... 15/228; 15/115; 15/229.6

(58) Field of Classification Search ..... 15/147.2, 15/228, 229.4, 229.6, 229.7, 229.8, 115, 231; D32/50

See application file for complete search history.

(56) References Cited

U.S. PATENT DOCUMENTS 3,056,989 A * 10/1962 Murphy ..... 15/231
3,261,049 A * 7/1966 Murphy ..... 15/147.2
3,295,155 A 1/1967 Belsky et al.
4,071,983 A * 2/1978 Thielen ..... 451/525
5,410,772 A * 5/1995 Lewis ..... 15/228
5,426,809 A * 6/1995 Muta ..... 15/228
5,584,091 A * 12/1996 Borofsky ..... 15/115
5,881,423 A 3/1999 Shumway et al.

FOREIGN PATENT DOCUMENTS

| | | |
|---|---|---|
| DE | 39 35 649 A1 * | 5/1991 |
| DE | 94 02 509 | 2/1994 |
| DE | 44 03 550 | 9/1995 |
| EP | 0 909 549 | 4/1999 |
| JP | 6-311954 | 11/1994 |
| JP | 908 47 30 | 3/1997 |
| JP | 2001-212055 | 8/2001 |

* cited by examiner

*Primary Examiner*—Gladys JP Corcoran
*Assistant Examiner*—Laura C Guidotti
(74) *Attorney, Agent, or Firm*—Kenyon & Kenyon LLP

(57) ABSTRACT

A wiper plate for a cleaning implement, in particular for damp and wet mopping, having an essentially flat cleaning surface, and having first facilities for fastening a handle and second facilities for the detachable fastening of an interchangeable mopping covering, the cleaning surface (7) being subdivided into at least two functional surfaces having different cleaning functions; and means are provided by which the functional surfaces may each be brought into use without the occurrence of substantial mutual, negative influences on their cleaning functions.

16 Claims, 3 Drawing Sheets

WIPER PLATE FOR A CLEANING IMPLEMENT

BACKGROUND OF THE INVENTION

1. Field of the Invention

The invention relates to a wiper plate for a cleaning implement, in particular for damp and wet mopping. More particularly, the invention is a wiper plate having an essentially flat cleaning surface, and having first facilities for fastening a handle and second facilities for the detachable fastening of an interchangeable mopping covering. The invention also relates to a cleaning implement having the wiper plate as such, as well as the use of the wiper plate for a cleaning implement.

2. Description of Related Art

Cleaning implements having wiper plates of the species have long been known, and have been described many times in the patent literature, such as in DE 44 03 550 C1. They are essentially made up of a wiper plate functioning as support and holding device for an interchangeable mopping covering, the mopping covering itself, as well as a handle which may be connected to the wiper plate articulatedly or rigidly. The known possibilities for fastening are manifold, and likewise are numerous techniques known for fastening the mopping covering or for its design.

The wiper plates are rectangular, as a rule, but are also designed trapezoidal-shaped. All wiper plates of the species have in common that the surface of the wiper plate facing the floor to be cleaned, from here on called cleaning surface, for simplicity's sake, is predominantly designed to be flat. The reason for this is that the optical impression of a cleaned surface is essentially determined by the evening out of the water film by the cleaning implement during cleaning.

An uneven distribution of the water film invariably leads to the formation of streaks on the cleaned floor, which become visible after drying. These so-called cleaning streaks are generally felt to be irritating. An effective measure for preventing the formation of these streaks is to design the wiper surface of the wiper plate as flat as possible.

The known cleaning implements having wiper plates of the species have the disadvantage that loosening of tough (stubborn) dirt, such as firmly adhering dirt, marks left by shoes, dried food remains, etc, is very difficult. Even when the contact pressure is increased via the handle, tough dirt comes off only after mopping several times, frequently with dirt residues still remaining, which then still have to be subsequently removed using a more suitable cleaning implement or by hand.

SUMMARY OF THE INVENTION

It is an object of the invention to further develop a wiper plate or rather a cleaning implement having such a wiper plate, in such a way that the known advantages, such as avoiding streaking, remain intact, but, on the other hand, the cleaning capability is improved even in the case of tough dirt. In addition, the wiper plate should be manufacturable as simply and as cost-effectively as possible.

These and other objects of the invention are achieved by a wiper plate for a cleaning implement, in particular for damp and wet mopping, having an essentially flat cleaning surface, and having first facilities for fastening a handle and second facilities for the detachable fastening of an interchangeable mopping covering, wherein the cleaning surface (7) is subdivided into at least two functional surfaces having different cleaning functions, and means are provided by which functional surfaces may be put to their respective use without the occurrence of substantial mutual, negative influence of their cleaning functions.

BRIEF DESCRIPTION OF THE DRAWINGS

The invention will be described in greater detail with reference to the following drawings wherein.

DETAILED DESCRIPTION OF THE INVENTION

Figure 1:
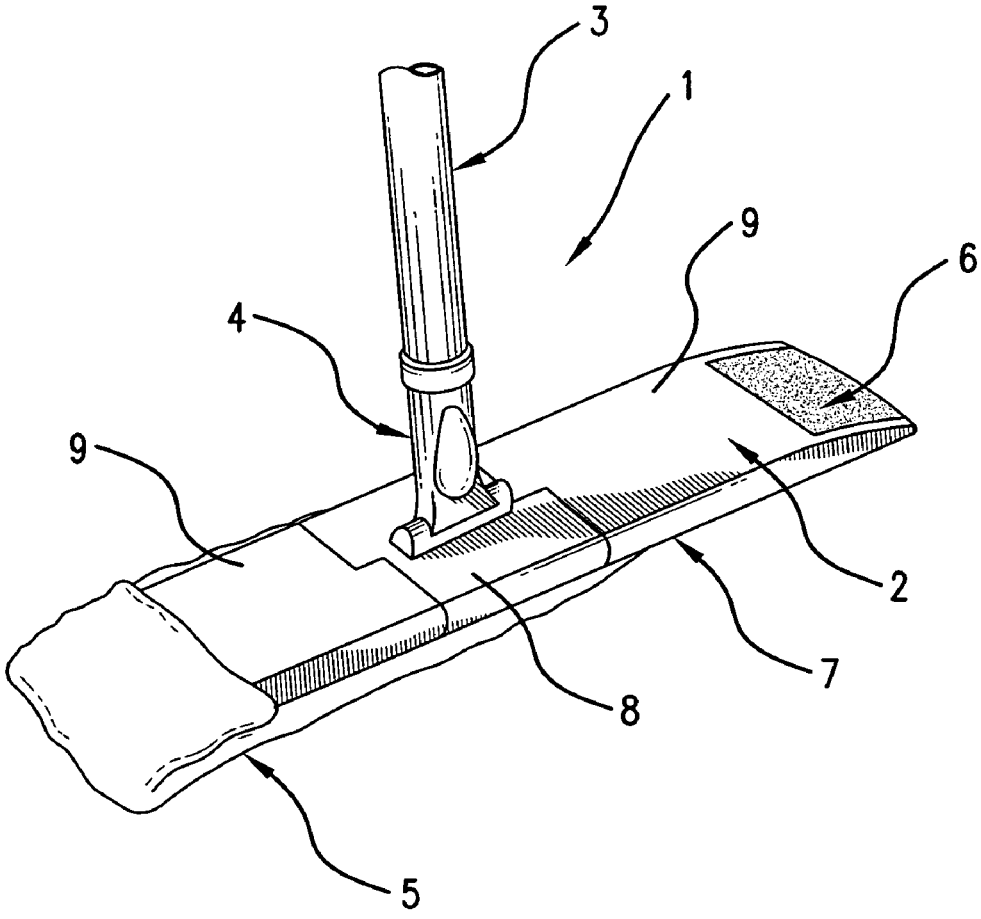
FIG. 1 shows in perspective illustration, a top view of a first specific embodiment of a wiper plate according to the invention, having a handle and a mopping covering.

The invention is based, for one thing, on the realization that one may advantageously take advantage of the design possibilities, in the case of a wiper plate, for the influencing control on the cleaning functions of a cleaning implement, i.e. that clear effects may be achieved in spite of the mopping covering located between the wiper plate and the surface to be cleaned, and for another thing, the further realization that the faults in the cleaning results described above are attributable to the fact that different cleaning functions, such as detaching tough dirt, evening out the water film, etc, require completely different, sometimes mutually exclusive designs of the cleaning surface. Thus, for example, the evening out of the water film is favored by a cleaning surface which is as flat as possible. However, a plane surface and the use of a correspondingly lesser contact pressure are less suitable for dislodging tough dirt. On the other hand, edges, bristles or the like, which favor mechanical removal of such dirt, lead to the formation of streaks mentioned above.

Therefore, according to the invention it is provided that the cleaning surface of the wiper plate be subdivided into at least two functional surfaces having different cleaning functions, and that means shall be provided, with the aid of which these functional surfaces may be put into use without substantial mutual, negative impairment of their respective cleaning functions.

According to one preferred specific embodiment of the present invention, exactly two functional surfaces are provided, the first functional surface having means for detaching tough dirt, and the second functional surface being formed essentially in a planar manner, for evening out the water film. Using this sort of embodiment, the disadvantages of the related art are overcome. Depending upon the degree of dirtying or the desired cleaning function, in each case either the one or the other functional surface may be used, without an additional cleaning implement being required.

In one advantageous embodiment of the present invention, the first functional surface is directly in the area of the fastening of the handle, and the second functional surface is formed from two partial surfaces which respectively adjoin the first functional surface on both sides, in the direction of the longer edges of the wiper plate. The advantages of such positioning is that the user intuitively places the first functional surface correctly above the surface that is difficult to clean, while the second functional surface evens out the result of the cleaning over the greatest possible range.

Especially preferred is a situation in which the first functional surface is directly in the area of fastening of the handle, and the second functional surface surrounds it in all directions. In this manner, an evening out of the water film takes place in all directions around the first functional surface, even when this is being used.

There are various possibilities for operating the first functional surface, such as by operating a push button, which has the effect of making the first functional surface slip out of the plane of the second functional surface and of locking it in this position. Once the tough dirt has been removed, the locking can be undone, and the first functional surface may be brought back. The constructive measures for implementing such a set-up are known to one skilled in the art, and are not discussed further at this point.

In another particularly preferred specific embodiment of the present invention, the first functional surface is simply operated by exerting pressure on the handle. This avoids operating mechanisms that require effort and are costly. In this connection, it makes no difference how the handle is fixed to the wiper plate. All ways of fastening it are conceivable, whether articulated or rigid. In particular, in combination with the central positioning of the first functional surface, cost of construction is low, and operation is especially simple. In order to detach tough dirt, pressure is exerted on the first functional surface in a simple manner via the handle. This is pressed against the floor, whereby its cleaning capability is improved some more. In this context, the laterally bordering surfaces of the second functional surface decline in their effectiveness because of the flexibility of the wiper plate and the vertical distance between the first and the second functional surface. Once the tough dirt has been removed, pressure is simply removed, and the cleaning function of the second functional surface outbalances the first again.

The two functional surfaces may be designed to be either integrally connected to each other or as partial pieces of the wiper plate, separated from each other. For instance, a partial piece carrying the first functional surface may be set into a corresponding recess in the wiper plate with the second functional surface. In that situation, the partial piece having the first functional surface may be fixedly connected to the wiper plate. An elastic connection may also be provided, the handle being fixedly connected to the partial piece carrying the first functional surface. Such an arrangement has the advantage that the operation of the first functional surface is supported to some extent by pressure exerted on the handle.

The wiper plate according to the present invention is made of plastic, as a rule, particularly of mass-produced plastics, such as polypropylene. The cleaning function and also the handling are advantageously also supported if the partial piece of the wiper plate carrying the first functional surface is made of a very hard material, such as a polyamide reinforced with glass fibers, and the partial piece carrying the second functional surface is made of a softer material, such as polyethylene or a thermoplastic elastomer.

Advantages of manufacturing technology are brought about if the means for detaching tough dirt include structuring the functional surface. Such structurings are produced especially simply and cost-effectively, for example, by injection molding or molding.

There are numerous design possibilities for such structuring. One skilled in the art will easily find the most advantageous solution for himself. Structurings which include, for example, ribs, elastic bristles or combinations thereof are particularly simple from a manufacturing technology point of view. According to requirements, for example, the ribs may have a half-round, rectangular, trapezoidal or triangular cross section.

The ribs may be situated parallel to the longer side of the wiper plate, i.e. essentially perpendicular to the mopping direction. However, those structures are preferred which deliver a good cleaning result that is largely independent of the direction of motion of the wiper plate. This may be achieved in a simple manner in that the ribs are positioned at an angle, particularly at an angle of about 45°, to the side edges of the wiper plate. For this purpose, structures such a arrow-shaped or tooth-shaped ones are conceivable. The structures may be symmetrical or asymmetrical.

Harking back to the classical floor cleaning implements of wiping cloth and scrubbing brush, in the case of floor cleaning implements, the structuring is designed, in a preferred specific embodiment of the present invention, in such a way that the ratio of the sum over all the raised surfaces, formed by the structuring of the functional surface, to the total surface of the wiper plate amounts to between about 1:10 and 1:100, especially preferred about 1:50. A ratio of 1:50 corresponds to about the ratio of the sum of the cross sectional surfaces of all bristles to the total cleaning surface of a classical scrubbing brush, i.e. when the structured functional surface is operated, about the same contact pressure is achieved on the surface to be cleaned as with the use of a scrubbing brush.

Thus, a cleaning implement having a wiper plate in this specific embodiment unites in itself, in an advantageous manner, the essential cleaning functions of the classical cleaning implements wiping cloth and scrubbing brush, but is substantially simpler and more comfortable to operate.

In order that the structuring of the functional surface will show to best effect through the mopping covering, the ratio of the structuring height and the thickness of the mopping covering should amount to approximately between 1:0.5 and 1:3, preferably about 1:2.

In the case of usual mopping covering thicknesses, structured heights of approximately 2 to 5 mm result. If the structured height is too great compared to the thickness of the mopping covering, this may lead to streak formation, and if it is too low, the effect of the structuring is too much impaired by the mopping covering.

There are no limitations on the choice of the mopping coverings. The most varied materials and designs may be used.

The wiper plate according to the present invention may be used in the most varied cleaning implements, such as floor or window cleaning implements. In principle, the present invention may be used in all cleaning implements which are intended for the cleaning of essentially flat surfaces. Also, the present invention is in no way limited to the combination, described as an example, of the two cleaning functions "scrubbing" and "evening out". Any number of cleaning functions, and particularly more than two, may be provided. The choice of these will, as a rule, depend on the kind of cleaning implement, its local set-up on the cleaning surface of the wiper plate and also on the selected operating mechanism.

In FIG. 1 one recognizes a cleaning implement 1 according to the present invention, having a wiper plate 2 and a handle 3, which is mounted on the upper side of wiper plate 2 with the aid of a fastening device 4. In the illustrated specific embodiment, handle 3 is connected articulatedly to wiper plate 2, without restriction of the general case. However, the present invention may also be applied to cleaning implements having a rigid connection to their handle. On one of the two sides of rectangular wiper plate 2, mopping covering 5 is illustrated. Mopping covering 5 is attached to the upper side of wiper plate 2 on both sides with the aid of fastening means 6. These may be, for example, pockets sewed on to the mopping covering, VELCRO® bands (hook and loop fasteners), snap fasteners or special fastening elements which are similar in their effect to snap fasteners. Mopping covering 5 completely covers cleaning surface 7 of wiper plate 2.

Figure 2:
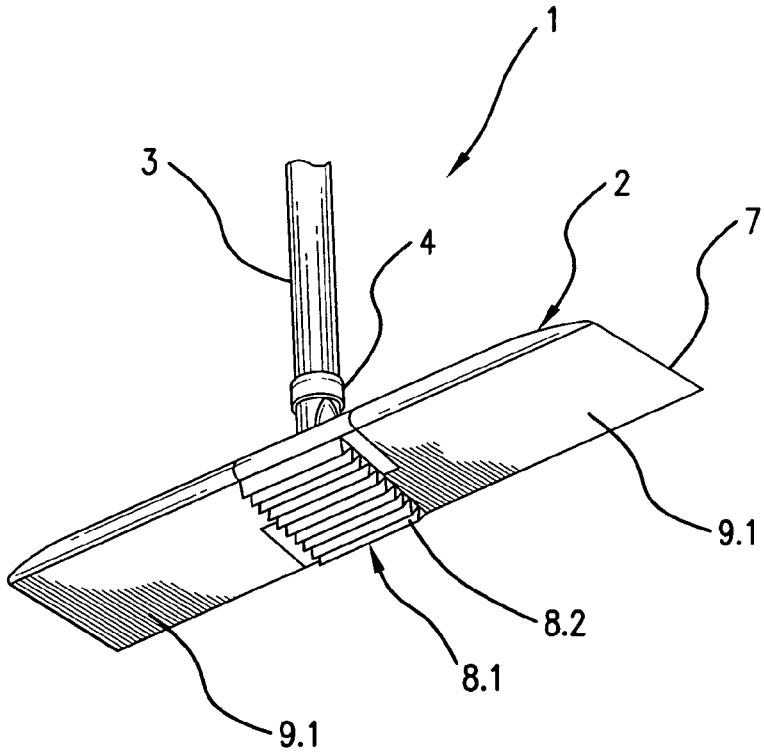
FIG. 2 shows in perspective illustration, the wiper plate of FIG. 1 in a view from below towards the cleaning surface.

In the region of the fastening 4 for handle 3, a central middle piece 8 has been inserted into wiper plate 2. In FIG. 2 one may recognize that this involves a partial piece of wiper plate 2 which carries first functional surface 8.1.

Figure 3:
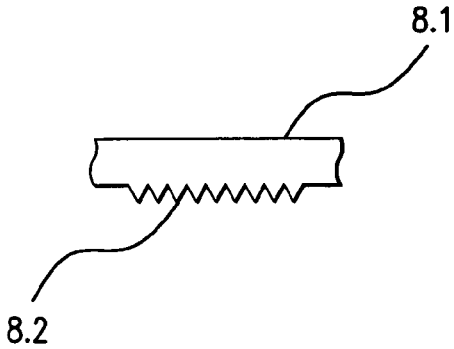
FIG. 3 shows in a side view, a section through the first functional surface perpendicular to the progression of the ribs.

Functional surface 8.1 is used for detaching tough dirt. For this purpose it has ribs 8.2, which, in the illustrated exemplary embodiment and without restriction of the general case, extend parallel to the longer edge of rectangular wiper plate 2, i.e. perpendicular to the main direction of motion of the cleaning implement. Ribs 8.2 have, for instance, a triangular cross section, as may be seen especially in FIG. 3. Depending on the application, other geometries may also be advantageous. The two partial pieces 9, having the partial pieces of second functional surface 9.1, on both sides adjoin the center piece 8 of wiper plate 2 having functional surface 8.1. This is designed to be flat and is used to even out the water film. In the exemplary embodiment shown, center piece 8 and partial piece 9 are firmly connected to each other.

In illustrated cleaning implement 1, during use and without special exertion of pressure on center piece 8 by handle 3, the cleaning function of the second, mostly flat functional surface 9.1 predominates. The pressure exerted during normal mopping is not sufficient to push ribs 8.2 of first functional surface 8.1 through the mopping covering. Only when pressure is increased is the mopping covering squeezed together over first functional surface 8.1 to such an extent that ribs 8.2 protrude compared to the second functional surface, and the main pressure is efficiently transmitted to the surface to be cleaned, via the crests of ribs 8.2. Dirt that sticks stubbornly is now more easily removed with the aid of the increased contact pressure.

Figure 4:
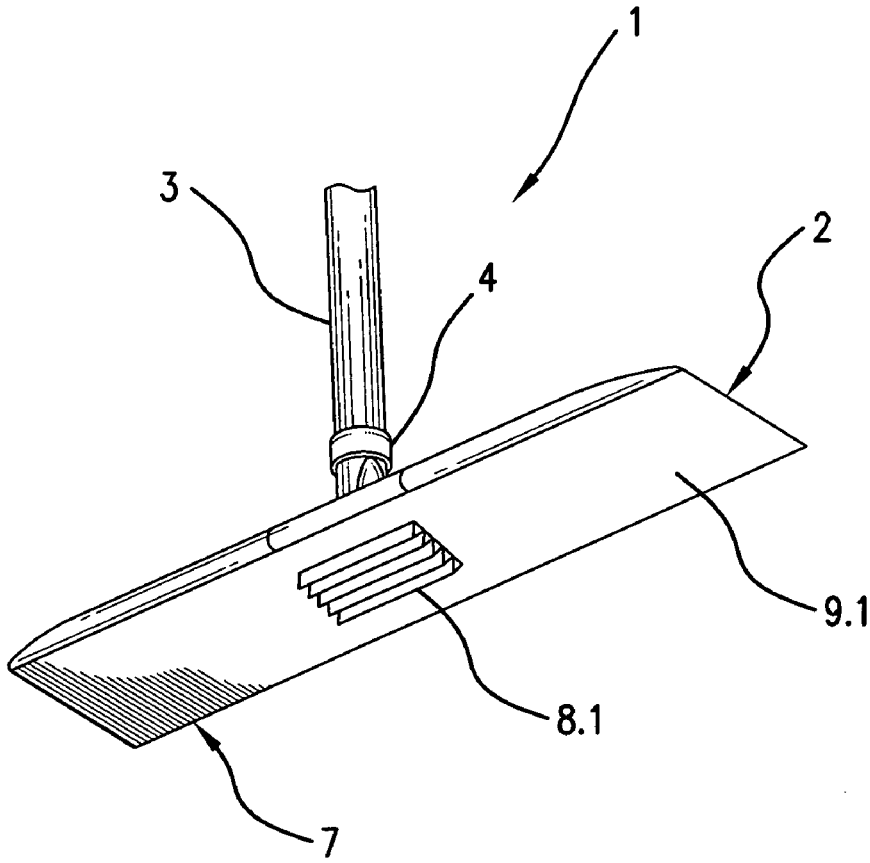
FIG. 4 shows in perspective illustration, a further specific embodiment of a wiper plate according to the invention in a view from below towards the cleaning surface.

FIG. 4 shows a further preferred specific embodiment of the present invention. One can see that first functional surface 8.1, having ribs 8.2, is centrally embedded in second functional surface 9.1. It is surrounded on all sides by partial pieces of second functional surface 9.1. This has the advantage that an evening out of the water film is effected in all directions, independently of the direction of motion, even during the operation of functional surface 8.1. This simplifies the handling of the cleaning implement, since one does not have to worry about possible streaking when selecting the direction of motion.

What is claimed is:

1. A wiper plate for a cleaning implement for damp and wet mopping, comprising: an essentially flat cleaning surface, a fastener for a handle and a detachable fastener for an interchangeable mopping covering, wherein the cleaning surface (7) is subdivided into at least two functional surfaces having different cleaning functions, wherein a first functional surface (8.1) is only configured on the cleaning surface (7) in a fastening area of the handle (3), and a second functional surface (9.1) is formed from two partial surfaces which respectively adjoin the first functional surface (8.1) on both sides of the first functional surface, the second functional surface being flat and wherein the first functional surface is configured to protrude from the covering compared to the second functional surface only when pressure is exerted on the wiper plate by a user, wherein the first functional surface includes a structuring for detaching tough dirt, and wherein the second functional surface is in a planar configuration.

2. The wiper plate according to claim 1, wherein the first functional surface (8.1) has means for detaching tough dirt, and the second functional surface (9.1) being formed essentially in the planar configuration, for evening out a water film.

3. The wiper plate according to claim 2, wherein the first functional surface (8.1) is directly in an area of the fastening (4) of the handle (3), and the second functional surface (9.1) is formed from two partial surfaces which respectively adjoin the first functional surface (8.1) on both sides.

4. The wiper plate according to claim 2, wherein the first functional surface (8.1) is located directly in an area of the fastening (4) of the handle (3), and the second functional surface (9.1) surrounds the former on all sides.

5. The wiper plate according to claim 1, wherein the first functional surface (8.1) is directly in an area of the fastening (4) of the handle (3), and the second functional surface (9.1) is formed from two partial surfaces which respectively adjoin the first functional surface (8.1) on both sides.

6. The wiper plate according to claim 1, wherein the first functional surface (8.1) is located directly in an area of the fastening (4) of the handle (3), and the second functional surface (9.1) surrounds the former on all sides.

7. The wiper plate according to claim 1, wherein the first functional surface (8.1) and the second functional surface (9.1) are integrally connected to each other, or are formed as partial pieces of the wiper plate (2) separated from one another.

8. The wiper plate according to claim 1, wherein the structuring is designed as ribs (8.2) which are positioned at an angle to the side edges of the wiper plate (2).

9. The wiper plate according to claim 8, wherein the angle is about 45°.

10. The wiper plate according to claim 1, wherein a ratio of a sum over all raised surfaces, formed by the structuring of the first functional surface (8.1), to a total surface of the wiper plate (2) is from 1:10 to 1:100.

11. The wiper plate according to claim 10, wherein the ratio is 1:50.

12. The wiper plate according to claim 1, wherein a ratio of a structured height of the structuring of the first functional surface (8.1) to a thickness of the mopping covering (5) is from 1:0.5 to 1:3.

13. The wiper plate according to claim 12, wherein the ratio of the structured height of the structuring of the first functional surface (8.1) to the thickness of the mopping covering (5) is about 1:2.

14. The wiper plate according to claim 12, wherein the structured height of the structuring of the first functional surface (8.1) is from 2 mm to 5 mm.

15. A cleaning implement for damp and wet mopping, comprising the wiper plate according to claim 1, a handle and an interchangeable mopping covering.

16. A cleaning implement for damp and wet mopping, comprising the wiper plate according to claim 2, a handle and an interchangeable mopping covering.

* * * * *

UNITED STATES PATENT AND TRADEMARK OFFICE

CERTIFICATE OF CORRECTION

PATENT NO. : 7,127,772 B2
APPLICATION NO. : 10/287938
DATED : October 31, 2006
INVENTOR(S) : Uwe Dingert et al.

It is certified that error appears in the above-identified patent and that said Letters Patent is hereby corrected as shown below:

Column 6, line 22, change "according to claim 1," to -- according to claim 2,--.

Signed and Sealed this

Twenty-fourth Day of April, 2007

JON W. DUDAS
*Director of the United States Patent and Trademark Office*